US005518481A

United States Patent [19]

Darkwah

[11] Patent Number: 5,518,481

[45] Date of Patent: May 21, 1996

[54] BODY SUPPORTED EXERCISE DEVICE

[76] Inventor: Banchie A. Darkwah, 2032 Skyline Dr., Russellville, Ark. 72801

[21] Appl. No.: 383,811

[22] Filed: Feb. 6, 1995

[51] Int. Cl.[6] ..... A63B 23/00; A63B 69/00

[52] U.S. Cl. ..... 482/126; 482/74

[58] Field of Search ..... 482/121, 125, 482/126, 122, 91, 74, 124, 131, 139, 148, 92

[56] References Cited

U.S. PATENT DOCUMENTS

| | | | |
|---|---|---|---|
| 743,204 | 11/1903 | Terry | 482/126 |
| 1,663,641 | 3/1928 | Smallwood . | |
| 3,680,858 | 8/1972 | Ossenkop et al. | 272/83 R |
| 3,785,645 | 1/1974 | Yosef | 272/82 |
| 4,247,117 | 1/1981 | Reichert | 273/411 |
| 4,337,938 | 7/1982 | Rodriguez | 482/74 |
| 4,441,707 | 4/1984 | Bosch | 482/74 |
| 4,762,318 | 8/1988 | Phillips et al. | 482/126 |
| 4,815,731 | 3/1989 | Suarez et al. | 272/139 |
| 4,909,506 | 3/1990 | Smith | 272/139 |
| 4,911,439 | 3/1990 | Kuhl | 272/139 |
| 4,961,573 | 10/1990 | Wehrell | 272/76 |
| 4,993,705 | 2/1991 | Tolle | 272/139 |
| 5,318,494 | 6/1994 | Santighian | 482/125 |

FOREIGN PATENT DOCUMENTS

| | | | |
|---|---|---|---|
| 9108025 | 6/1991 | WIPO | 482/126 |

*Primary Examiner*—Stephen R. Crow
*Attorney, Agent, or Firm*—Ray F. Cox, Jr.

[57] ABSTRACT

A resilient stretching exercise device worn on the body of the user, in particular about the arms and shoulders. The device has four contiguous loops of resilient cord. The two inner loops pass around the back and through the arms of the user. The two outer loops terminate in handgrips whereby the user may exercise arms, shoulders and upper body while walking by pumping the arms against the resistance of the resilient cord.

4 Claims, 3 Drawing Sheets

BODY SUPPORTED EXERCISE DEVICE

BACKGROUND OF THE INVENTION

This invention relates to an exercise device and, in particular, to a resilient stretching device worn on the body of the user, whereby the user may engage in the exercise of the arms, shoulders and upper body while walking.

At the present time there is a great deal of interest in physical fitness. Various types of exercises and exercising devices have been recommended for use by the general public in achieving physical fitness goals. A particularly popular class of exercising devices simulates the effects of walking or cross-country skiing. These types of devices typically include a treadmill or slidable foot rests to simulate the motions of the user in walking or cross-country skiing. In addition, the devices often include means to simultaneously exercise the arms, shoulders and upper body; for example, poles to simulate ski poles or rope and pulley arrangements biased by springs or weights.

The stationary exercising devices described above are expensive and cumbersome substitutes for the type of exercise that is being simulated. While the option of cross-country skiing is not available to all of those who seek the benefits of aerobic exercise, walking is available to most people and has been recognized by physical fitness authorities as an excellent form of exercise for developing cardiovascular fitness while placing a low level of stress on the musculature and skeletal system of the user. There are additionally numerous benefits and advantages of walking in an outdoor environment as opposed to the use of a stationary exerciser indoors. Walking has been found to be less monotonous and therefore more likely to be sustainable over the long term. Furthermore, modern energy efficient architecture has contributed to polluted indoor air. Indoor air, in fact, may be much more polluted than most outdoor air. Walking is also low cost and requires no complicated, cumbersome and expensive machinery. Walking may also result in a more natural motion and the variety of terrains encountered in an outdoor environment may result in a more all around form of exercise as opposed to mechanically assisted exercise which may over exercise certain muscle groups while avoiding other muscle groups entirely.

The one limitation on outdoor walking exercise is that while walking exercises the legs, lower body and cardiovascular system, the upper body, arms and shoulders will typically not be as thoroughly exercised in the absence of an exercising aid of some type. For example, in U.S. Pat. No. 4,961,573 issued to Wehrell on Oct. 9, 1990 for "Boxing Exercise Harness", a mobile exercise harness for boxers is disclosed which allows the user to exercise the arms, chest and shoulders by moving handgrips against the resistive force of elastic cords. The elastic cords are mounted on a harness which is supported by the body of the user. The elastic cords are directed through an arrangement of pulleys to provide a more nearly constant force of resistance to the arms of the user.

U.S. Pat. No. 4,911,439 issued to Kuhl on Mar. 27, 1990 for "Body Supported Resilient Exercise Apparatus", discloses an exercise device in which an elastic cord is formed into a figure 8 shape, including two loops that are coincident at a common juncture. The two loops are releasably interconnected at a point opposite the common juncture. The device is worn as a harness about the upper body of the user. Each of the loops formed from the resilient cord have tubular handles for grasping and extending by the user.

A similar device is disclosed in U.S. Pat. No. 4,993,705 issued to Tolle on Feb. 19, 1991 for "Athletic Device." Tolle discloses a vest worn by the user in which an elastic strap is fastened across a back part of the vest and terminates in cuff connections for the arms of the user.

U.S. Pat. No. 1,663,641 issued to Smallwood on Mar. 27, 1928 for "Exerciser and Blood Circulator" discloses an arrangement of two endless elastic bands connected together at the front and the back so that the device is worn around the upper body of the user and extended in loops around the feet of the user.

Another form of exercising device using loops of elastic cord is disclosed in U.S. Pat. No. 5,318,494 issued to Santighian on Jun. 7, 1994 for "Elastically Resilient Exercise Device." Santighian discloses an exercise device comprising an elastic cord forming a continuous loop, three movable rings form three adjustable loops out of the continuous loop, two lower loops form stirrups to hold each foot of the user, and an apex loop is capable of exercising the head or neck of the user or to be gripped by the hands of the user.

SUMMARY OF THE INVENTION

It is a primary object of the present invention to provide for a device for exercising the arms, shoulders and upper body of a user while the user is walking. The device is intended to overcome the limitations and deficiencies of the prior art by providing for a device which is simple in construction and easy for the user to wear on the body and simple and straightforward in application. These objectives are achieved by forming the exercising device of the present invention out of a continuous loop comprised substantially of resilient elastic cord. Certain negligible portions of the continuous loop may be comprised of non-resilient fasteners or connectors. The continuous loop is gathered together at three points to form four contiguous loops. The two inner loops are worn about the arms and shoulders of the user. The two outer loops terminate in handgrips so that the user may exercise the arms against the resistance provided by the resilient outer loops. The exercise device can be made in a variety of lengths and elasticities to accommodate different sizes and physical types of users.

It is therefore an object of the present invention to provide for an exercising device using resilient elastic cords to provide exercise for the arms, shoulders and upper body of the user.

It is the further object of the present invention to provide for an exercise device that is simple in both construction and use.

It is an additional object of the present invention to provide for an exercising device which may be worn on the body of the user in a natural and comfortable fashion.

DETAILED DESCRIPTION OF THE PREFERRED EMBODIMENTS

Figure 1:
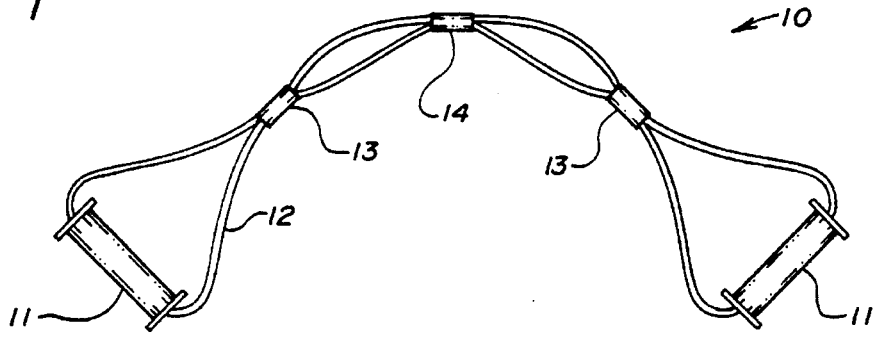
FIG. 1 is a plan view of the exercise device.

The exercise device designated generally as 10 is described with reference to FIG. 1. The exercise device 10 comprises a continuous loop 12 composed substantially of resilient elastic cord. Portions of the continuous loop 12 may be composed of nonresilient segments such as connectors. The resilient cord of the continuous loop 12 has a predetermined circumferential length and elasticity. The length and elasticity are selected to provide for the appropriate degree of resistance to the exercise motions of the user. The exercise device 10 may then be produced in varying sizes and strength of resistance to accommodate users of various sizes and physical types.

The continuous loop 12 is gathered together at three points to form four contiguous loops. Central juncture means 14 joins the continuous loop at a point which, when the device is worn, will be found near the middle of the back of the user.

Secondary juncture means 13 gather the continuous loop 12 at points flanking the central juncture 14 so as to form inner loops between the central juncture means 14 and each of the secondary juncture means 13 and outer loops flanking the inner loops and contiguous with the outer loops at the point formed by the secondary juncture means 13. Handgrips 11 are received about a portion of each of the outer loops of the continuous loop 12.

The central juncture means 14 and the secondary juncture means 13 in the preferred embodiment comprise a length of plastic tubing material sized to fit over the doubled segment of the continuous loop 12 at each of the juncture points forming the four contiguous loops. In the preferred embodiment, the central juncture means 14 and secondary juncture means 13 may allow a degree of adjustment by sliding along the continuous loop 12. Alternative embodiments of the central juncture means 14 and secondary juncture means 13 include stitching, weaving or crimped metal connectors. The examples, however, should not be considered limiting to the scope of the present invention. Any means capable of forming the four contiguous loops in the continuous loop 12 would be considered within the scope of the invention.

Figure 2:
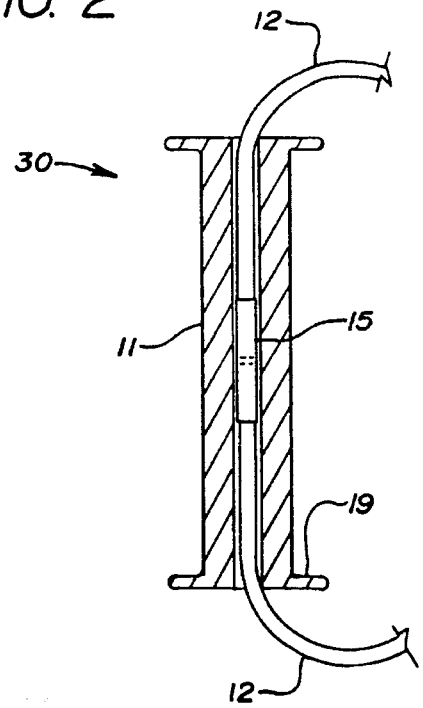
FIG. 2 is a sectional elevation of one embodiment of the handgrip of the exercise device.

FIG. 2 illustrates one embodiment 30 of the handgrip 11. The handgrip 11 is tubular with peripheral flanges 19 to comfortably be grasped by the hand of the user. The continuous loop 12 passes through the tubular handgrip 11. In this embodiment the continuous loop 12 is formed by joining a length of elastic cord at its two ends by a crimped metal connector 15.

Figure 3:
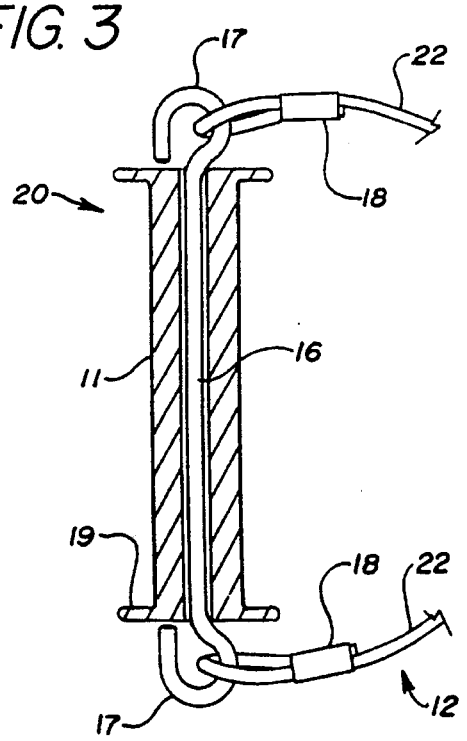
FIG. 3 is a sectional elevation of an alternative embodiment of the handgrip of the exercise device.

An alternative embodiment 20 of the handgrip 11 is shown in FIG. 3. Again the handgrip 11 is tubular with peripheral flanges 19. A metal rod 16 passes through the tubular handgrip 11 and is provided with end loops 17 which are disposed outward of the handgrip 11. In this embodiment the continuous loop 12 is formed from two segments 22 of elastic cord material. Each end of a segment 22 passes through the loop 17 and is fastened thereto by a crimped metal connector 18. The continuous loop 12 is thus comprised of the two elastic cord segments 22 and the two metal rods 16 so as to form a single continuous loop 12 which is substantially comprised of elastic cord material.

Figure 4:
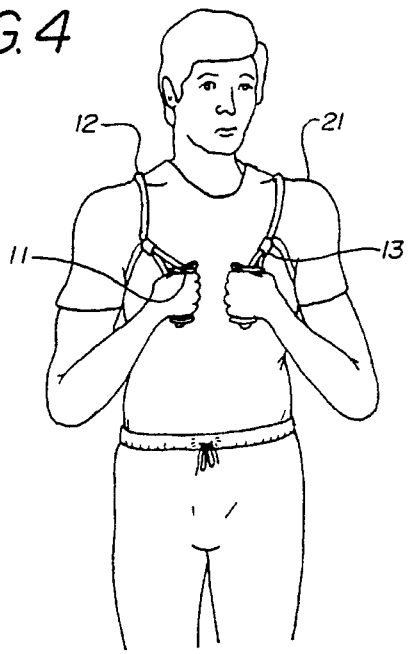
FIG. 4 is a front elevation view of the exercise device as worn on the body of the user.
Figure 5:
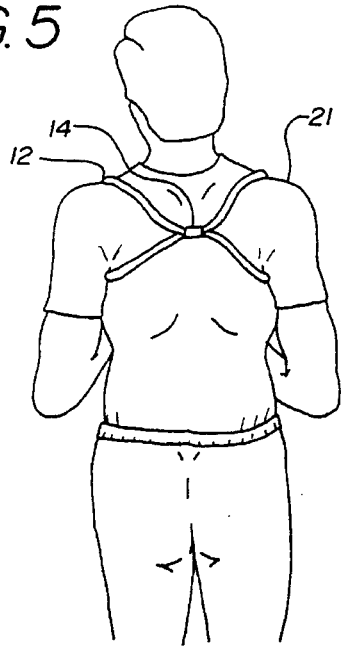
FIG. 5 is a rear elevation view of the exercise device as worn on the body of the user.

The wearing of the exercise device 10 by the user 21 is described with reference to FIGS. 4 and 5. The two inner loops of elastic cord formed between the central juncture means 14 and the secondary juncture means 13 receive the arms and shoulders of the user 21 such that the central juncture means 14 is located in the center of the back of the user 21. The secondary juncture means 13 are disposed to the front of each shoulder of the user 21. The user 21 is then able to grasp each handgrip 11 by the respective hand of the user 21.

Figure 6:
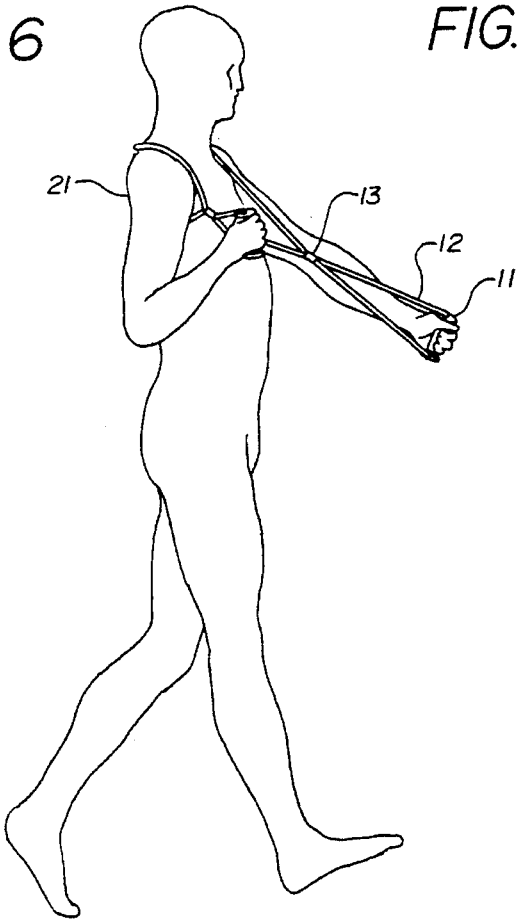
FIGS. 6 and 7 are right side elevation views of the device as worn on the body of the user showing exercising motions of the user while walking.
Figure 7:
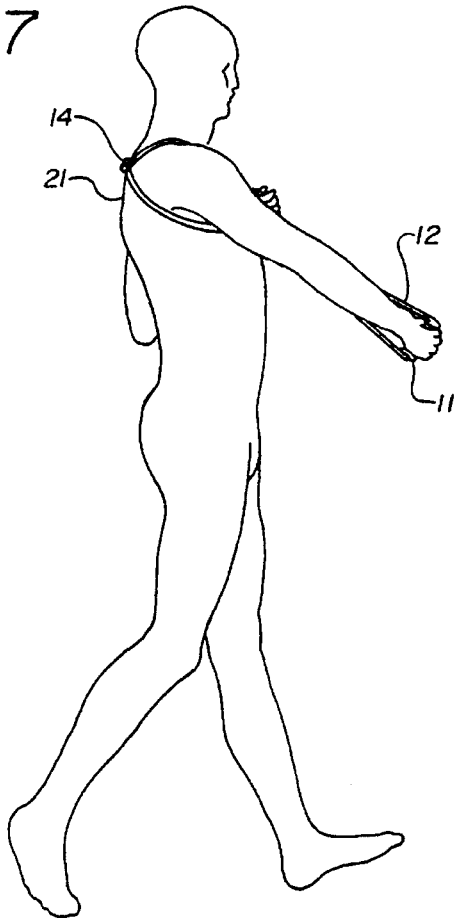
Figure 8:
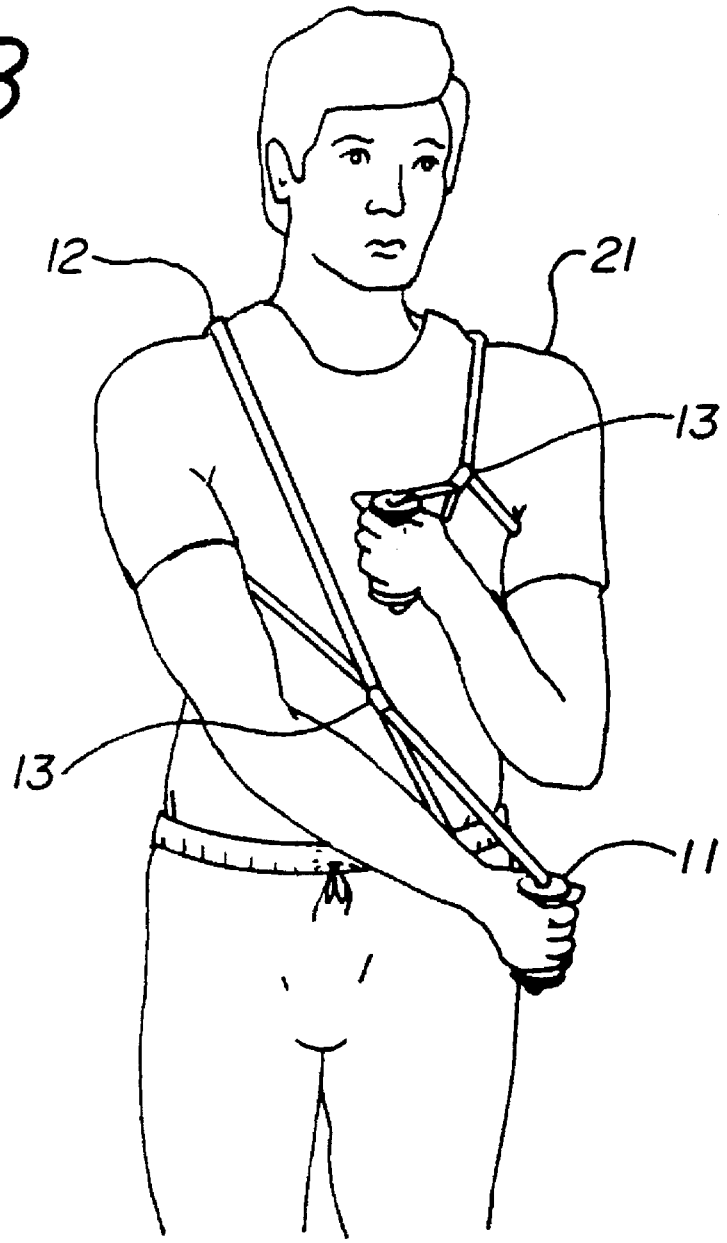
FIG. 8 is a front elevation of the exercise device as worn on the body of the user showing exercising motion of the user corresponding to that shown in FIG. 7.

The use of the exercise device 10 by the user 21 is described with reference to FIGS. 6, 7 and 8. The exercise device 10 is primarily intended to be used to exercise the arms, shoulder and upper body of the user 21 while walking. While grasping the handgrips 11, the user walks at a normal exercise gait. The left hand of the user is thrust forward in rhythm with the forward movement of the right leg of the user 21. As the right leg and left arm of the user are withdrawn, the right arm and left leg of the user 21 move forward in unison. This sequence of motions is repeated. The resilient cord of the continuous loop 12 thus acts to provide resistance against the thrusting arm motions of the user 21. Both the inner loops formed between the central juncture means 14 and the secondary juncture means 13 and the outer loops formed between the secondary juncture means 13 and the handgrips 11 provide a portion of the stretching resistance.

While the present invention has been described with reference to certain preferred and alternative embodiments, it is to be recognized that variations and modifications would occur to those skilled in the art and that the embodiments described herein are illustrative only and that the full scope of the invention is to be defined by the appended claims.

What is claimed is:

1. An exercise device comprising:

(a) a continuous loop comprised substantially of resilient cord having a predetermined circumferential length and elasticity;

(b) four contiguous loops formed of said continuous loop, comprising a pair of inner loops having common juncture means defining a common juncture between said inner loops, and a pair of outer loops, each of said outer loops having secondary juncture means defining a secondary juncture between each of said inner loops and a respective outer loop;

(c) a pair of handgrips, each of said handgrips being received about a portion of one of said outer loops, whereby the two inner loops pass around the back and through the arms of the user, and the two outer loops receive said handgrips, whereby said resilient cord is sized so as to allow the user to exercise while walking by pumping the arms against the resistance of the resilient cord.

2. The exercise device of claim 1 wherein said common juncture means and said secondary juncture means comprise tubes slidably received about said continuous loop so as to define a plurality of contiguous loops.

3. The exercise device of claim 1 wherein said common juncture means and said secondary juncture means comprise stitching between opposed points on said continuous loop so as to define a plurality of contiguous loops.

4. The exercise device of claim 1 wherein said continuous loop comprises two segments of elastic cord, each having respective first and second ends, and a pair of rods, each having first and second ends and first and second attachment loops formed in each of said first and second ends respectively of said rods; and further wherein said first ends of said elastic cords are each attached to one of said first attachment loops of said rods and said second ends of said elastic cords are each attached to one of said second attachment loops of said rods; and further wherein said handgrips are received about said rods.

* * * * *